US008052925B2

(12) United States Patent
Sakamoto et al.

(10) Patent No.: US 8,052,925 B2
(45) Date of Patent: Nov. 8, 2011

(54) LOW CARBON RESULFURIZED FREE-MACHINING STEEL HAVING HIGH MACHINABILITY

(75) Inventors: Koichi Sakamoto, Kobe (JP); Hiroshi Yaguchi, Kobe (JP); Atsuhiko Yoshida, Kobe (JP); Goro Anan, Kobe (JP); Yoshiteru Fukuoka, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 407 days.

(21) Appl. No.: 11/997,612

(22) PCT Filed: Sep. 7, 2006

(86) PCT No.: PCT/JP2006/317769

§ 371 (c)(1),
(2), (4) Date: Feb. 1, 2008

(87) PCT Pub. No.: WO2007/046198

PCT Pub. Date: Apr. 26, 2007

(65) Prior Publication Data

US 2010/0104468 A1 Apr. 29, 2010

(30) Foreign Application Priority Data

Oct. 17, 2005 (JP) ..... 2005-301552

(51) Int. Cl.
*C22C 38/60* (2006.01)

(52) U.S. Cl. ..... 420/87; 420/88

(58) Field of Classification Search ..... 420/87, 420/88; 148/320
See application file for complete search history.

(56) References Cited

U.S. PATENT DOCUMENTS

| | | | |
|---|---|---|---|
| 6,635,129 | B1 | 10/2003 | Nagahama et al. |
| 2007/0044867 | A1 | 3/2007 | Yaguchi et al. |

FOREIGN PATENT DOCUMENTS

| | | | |
|---|---|---|---|
| EP | 0 838 534 | A1 | 4/1998 |
| EP | 1 580 287 | A1 | 9/2005 |
| JP | 6-100978 | | 4/1994 |
| JP | 07 173574 | | 7/1995 |
| JP | 7-252588 | | 10/1995 |
| JP | 09 031522 | | 2/1997 |
| JP | 09 071838 | | 3/1997 |
| JP | 2671086 | | 10/1997 |
| JP | 2740982 | | 4/1998 |
| JP | 10 158781 | | 6/1998 |

(Continued)

OTHER PUBLICATIONS

U.S. Appl. No. 12/095,040, filed May 27, 2008, Sakamoto, et al.

*Primary Examiner* — Deborah Yee
(74) *Attorney, Agent, or Firm* — Oblon, Spivak, McClelland, Maier & Neustadt, L.L.P.

(57) ABSTRACT

A low carbon resulfurized free-machining steel having a high machinability is provided. This steel comprises 0.02 to 0.15% by mass of C, up to 0.004% by mass (more than 0% by mass) of Si, 0.6 to 3% by mass of Mn, 0.02 to 0.2% by mass of P, 0.2 to 1% by mass of S, up to 0.005% by mass (more than 0%) of Al, 0.008 to 0.04% by mass of O, and 0.002 to 0.03% by mass of N; and the average oxygen concentration in the MnS in the steel is at least 0.4% by mass.

9 Claims, 3 Drawing Sheets

FOREIGN PATENT DOCUMENTS

| | | |
|---|---|---|
| JP | 2922105 | 7/1999 |
| JP | 2000 319753 | 11/2000 |
| JP | 2001 152281 | 6/2001 |
| JP | 2001 152282 | 6/2001 |
| JP | 2001 152283 | 6/2001 |
| JP | 2001 207240 | 7/2001 |
| JP | 2003 253390 | 9/2003 |
| JP | 2004 169054 | 6/2004 |
| JP | 2004 359970 | 12/2004 |
| JP | 2005 23342 | 1/2005 |
| JP | 2005-23342 | 1/2005 |
| JP | 2005 187935 | 7/2005 |
| JP | 2006 200032 | 8/2006 |
| WO | WO 2005/054532 A1 | 6/2005 |

LOW CARBON RESULFURIZED FREE-MACHINING STEEL HAVING HIGH MACHINABILITY

CROSS-REFERENCE TO RELATED APPLICATIONS

This application is a 371 of PCT/JP2006/317769 filed Sep. 7, 2006 and claims the benefit of JP 2005-301552 filed Oct. 17, 2005.

TECHNICAL FIELD

This invention relates to a low carbon resulfurized free-machining steel which exhibits favorable roughness of the finished surface after machining and which has been produced without using lead which is toxic to the human body.

BACKGROUND ART

A low carbon resulfurized free-machining steel is a versatile steel material which is widely used for hydraulic components in automobile transmission and other small parts such as screws and printer shafts which do not require particularly high strength. When an improved roughness of the finished surface after machining and ease of chip disposability are required, a lead sulfur free-machining steel produced by adding lead (Pb) to the low carbon resulfurized free-machining steel is used.

Pb in the free-machining steel is quite effective in improving machinability of the steel. This Pb, however, has been pointed out to be an element which is toxic to the human body, and Pb is also associated with various other problems including lead fumes in steelmaking and chip disposability. In view of such situations, there is a strong demand for a free-machining steel which has realized a practical machinability without adding Pb.

With regard to such low carbon resulfurized free-machining steel, various techniques have been proposed for realizing a Pb-free steel having an improved machinability. For example, Patent Document 1 proposes a technique in which the machinability (roughness of the finished surface and easiness in disposing of the chips) has been improved by controlling size of the sulfide inclusion. Patent Document 2 discloses importance of controlling oxygen content in the steel for controlling the size of the sulfide inclusion. Also proposed are techniques of improving machinability by controlling oxide inclusion in the steel (see, for example, Patent Documents 3 to 5).

In the meanwhile, also proposed are techniques of improving the machinability by adequately controlling the chemical composition of the steel material (See for example, Patent Documents 6 to 9).

The techniques that have been proposed are useful in view of improving the machinability of the free-machining steel. The steel produced by these techniques, however, did not have the favorable machinability of the level comparable to the Pb-containing steel, in particular, in the roughness of the finished surface after the forming process.

In addition to the machinability as described above, it is also important that the Pb-free steel also has a good productivity. In this view, the steel should also be capable of being produced by continuous casting with no occurrence of surface defects and the steel also needs to be capable of rolling. However, such continuous casting process has been said to be disadvantageous in producing a steel having a good machinability. Therefore, it is also important to provide a free-machining steel with a good machinability which can be produced by the continuous casting.

[Patent Document 1] Japanese Patent Laid-Open No. 2003-253390

[Patent Document 2] Japanese Patent Laid-Open No. 1997-31522

[Patent Document 3] Japanese Patent Laid-Open No. 1995-173574

[Patent Document 4] Japanese Patent Laid-Open No. 1997-71838

[Patent Document 5] Japanese Patent Laid-Open No. 1999-158781

[Patent Document 6] Japanese Patent Laid-Open No. 2000-319753

[Patent Document 7] Japanese Patent Laid-Open No. 2001-152281

[Patent Document 8] Japanese Patent Laid-Open No. 2001-152282

[Patent Document 9] Japanese Patent Laid-Open No. 2001-152283

DISCLOSURE OF THE INVENTION

The present invention has been completed in view of the situation as described above, and an object of the present invention is to provide a low carbon resulfurized free-machining steel which has excellent machinability (in particular, favorable roughness of the finished surface) in spite of the absence of Pb, and which can be produced by continuous casting with high productivity.

To sum up, the low carbon resulfurized free-machining steel which has realized the objects as described above is a low carbon resulfurized free-machining steel having a high machinability comprising 0.02 to 0.15% (% stands for % by mass, and this also applies to the following) of C; up to 0.004% (more than 0%) of Si; 0.6 to 3% of Mn; 0.02 to 0.2% of P; 0.2 to 1% of S; up to 0.005% (more than 0%) of Al; 0.008 to 0.04% of O; and 0.002 to 0.03% of N; wherein average oxygen concentration in MnS in the steel is at least 0.4%.

The objects as described above can also be realized by the low carbon resulfurized free-machining steel which has the chemical composition as described above, and which satisfies either one of the following requirements (a) and (b):

(a) soluble Si in the steel is up to 35 ppm, and soluble Al is up to 1 ppm; and (b) average composition of non-metallic inclusion having an area of at least 25 $\mu m^2$ in the solidified bloom standardized by MnO—$SiO_2$—MnS ternary system comprises up to 60% by mass of MnS, up to 4% by mass of $SiO_2$, and at least 36% by mass of MnO.

In the low carbon resulfurized free-machining steel of either constitution, it is also useful to control the chemical composition such that (1) the soluble N is in the range of 0.002 to 0.02%, or (2) total of at least one element selected from Ti, Cr, Nb, V, Zr, and B is up to 0.02% (more than 0%). When such requirement is satisfied, the low carbon resulfurized free-machining steel of the present invention will have further improved properties.

According to the present invention, a large number of large spherical MnS which act as the site of minute crack generation can be incorporated in the steel by controlling average oxygen concentration of MnS in the steel to the level of at least 0.4%, without necessarily involving increase in the content of the free oxygen in the molten steel (namely, even if the steel has a high Mn concentration and a high S concentration), and the resulting low carbon resulfurized free-machining steel will enjoy favorable roughness of the finished surface. In addition, the low carbon resulfurized free-machining steel of the present invention can be produced at a high productivity by adequately carrying out the deoxidation immediately before the casting.

BEST MODE FOR CARRYING OUT THE INVENTION

Figure 1:
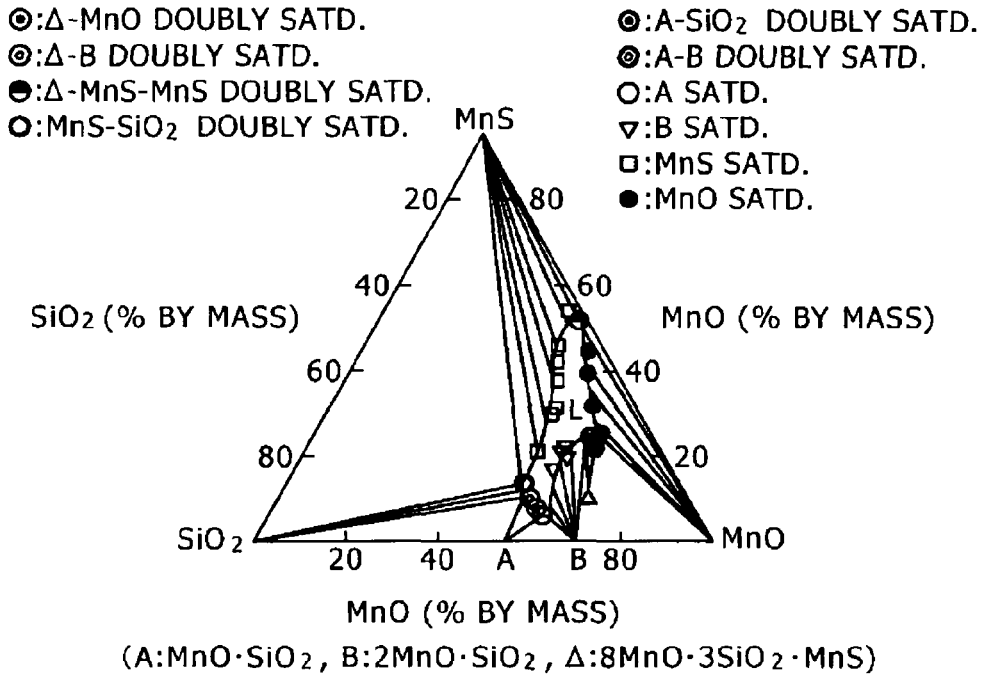
FIG. 1 is a phase diagram of an isothermal cross section of MnO—$SiO_2$—MnS ternary system at 1250° C.

Roughness of the finished surface of the free-machining steel largely depends on the generation of the built-up edge, and its size, shape, and uniformity. A built-up edge is a phenomenon in which a part of the work material deposits on the edge of the tool and virtually behaves as apart (edge) of the tool, and behavior of the built-up edge formed may adversely affect the roughness of the finished surface. Although the built-up edge is formed only under certain set of conditions, the conditions generally used in the cutting of the steel are likely to promote the built-up edge formation in low carbon resulferized free-machining steel.

While the built-up edge may result in fatal defects of the finished product depending on the built-up edge size, the built-up edge also has the effect of protecting the edge of the tool to extend the life of the tool. Therefore, complete prevention of the formation of the built-up edge might not be the best plan, and stable formation of the built-up edge with uniform size and shape is required.

In order to form a built-up edge with uniform size and shape, it is important to generate a large number of minute cracks throughout the primary and secondary shear zones of the part to be cut. Such generation of the cracks in a large number needs introduction of sites for inducing the crack formation. MnS inclusion is a known candidate which may be useful as the site for inducing the formation of minute cracks. However, it is not all MnS inclusions that may function as the sites for inducing the formation of minute cracks, and only MnS in the form of a large sphere (namely, MnS having a large width) are effective. When the MnS is stretched in the primary and secondary shear zones to an excessive degree and the stretched MnS has an excessively small width, most of such MnS will be in a state similar to the matrix, and such MnS no longer functions as the sites for inducing the formation of minute cracks. Accordingly, MnS inclusion of the work material should be preliminarily controlled to a large spherical shape.

Formation of large spherical MnS inclusions has been known to have general relation with the oxygen concentration in the steel ("total oxygen"), and increase in the sulfide diameter has been correlated with the increase in the oxygen in the steel. Accordingly, production of large spherical MnS inclusions requires increase in the oxygen concentration of the steel to a certain degree. In the meanwhile, increase in the number of the MnS inclusions which function as the sites for inducing the formation of minute cracks simultaneously requires increase of Mn and S concentrations compared to conventional free-machining steels (for example, JIS SUM23 and SUM24L). However, increase in the concentration of the Mn and the S which act as deoxidating agents invites decrease in the amount of free oxygen, and in turn, decrease in the total oxygen concentration. In other words, there is a trade-off between the increase in the total oxygen of the steel and the increase in the Mn and S concentrations, and simultaneous realization of both is associated with theoretical difficulty.

Under such conditions, the inventors of the present invention investigated the techniques that can be used in forming large spherical MnS inclusions from various approaches, and found that when oxygen content in the MnS is at least 0.4% on average, large spherical MnS inclusions can be generated in a large number, and the finishing roughness of the steel material can be thereby improved without necessarily involving the increase in the content of the free oxygen in the molten steel (namely, even if the steel has a high Mn concentration and a high S concentration) and without increasing the total oxygen concentration.

In order to control the oxygen concentration in the MnS to the level of at least 0.4%, the steel composition may be controlled by limiting the soluble Si in the steel to the level of up to 0.0035% (up to 35 ppm) and the soluble Al to the level of up to 0.0001% (up to 1 ppm) to thereby control the average composition of the inclusions in the bloom standardized in terms of MnO—$SiO_2$—MnS ternary system (namely, by assuming the sum of MnO, $SiO_2$, and MnS to be 100%) such that MnS is up to 60%, $SiO_2$ is up to 4%, and MnO is at least 36%. It is to be noted that the oxygen concentration in the MnS is preferably at least 0.6%, and more preferably at least 0.8%, and in order to increase the oxygen concentration in the MnS, further decrease in the Si is preferable.

In the investigation by the inventors of the present invention, it was also found that content of the soluble N in the steel is also highly relevant with the generation of minute cracks and an adequate regulation of the content of the soluble N contributes to the production of a free-machining steel having good machinability. In the primary and secondary shear zones as described above, temperature greatly differs with slight difference in the location, and when the soluble N is present at a certain amount, such difference in the temperature by the location results in the considerable difference of deformation resistance. This difference contributes to the generation of minute cracks and the site of the minute crack generation is thereby created. Therefore, it is quite effective to ensure the presence of the soluble N by regulating the content of the components which fix the soluble N, namely, the content of the components such as Ti, Cr, Nb, V, Zr, and B which are inclined to form nitrides to a certain level or lower.

In the present invention, the inventors found that a stable formation of the built-up edge with uniform size and shape can be realized, for example, by the 2 phenomena as described above, namely, (1) by the formation of the large spherical MnS inclusions, and (2) by the increase in the soluble N, and as a consequence of such stable formation of the built-up edge, roughness of the finished surface after the forming process is remarkably improved to exhibit properties comparable to those of the Pb-containing free-machining steel.

In the free-machining steel of the present invention, adequate control of the chemical composition is necessary. The content of C, Si, Mn, P, S, Al, O, and N which are the basic components of the free-machining steel have been controlled for the reason as described below.

C: 0.02 to 0.15%

C is an element which is essential in ensuring the strength of the steel. Addition of at least a certain amount of C is also necessary to improve the roughness of the finished surface. In order to realize such effects of the C addition, content of at least 0.02% is required. An excessive addition, however, results in the shortened life of the tool used for the cutting, and hence, in poor machinability, and also, in the occurrence of defects due to the CO gas generation during the casting. In view of such situation, content of the C is preferably up to 0.15%. The preferable lower limit of the C content is 0.05%, and the preferable upper limit is 0.12%.

Si: not More than 0.004% (More than 0%)

Si is an element which is essential in ensuring strength by solution strengthening. Si, however, basically acts as a deoxidating agent to produce $SiO_2$, and this $SiO_2$ contributes to the composition of the inclusion which is a MnO—$SiO_2$—MnS system. When Si is in excess of 0.004%, oxygen concentration in the MnS is no longer ensured due to the increase in the concentration of the $SiO_2$ in the inclusion, and this results in the unfavorable roughness of the finished surface. In view of such situation, Si content should be up to 0.004%, and preferably up to 0.003%.

Mn: 0.6 to 3%

Mn has the action of improving hardenability to promote generation of bainite structure and improve machinability. Mn is also an element which effectively ensures the strength. Furthermore, Mn forms MnS by binding to S and MnO by binding to O to thereby form MnO—MnS complex inclusion and realizes an improved machinability. In order to realize such effects of Mn, Mn should be included at least at a content of 0.6% while addition of Mn in excess of 3% may result in an excessively improved strength, and in turn, reduced machinability. It is to be noted that the preferable lower limit of the Mn content is 1% while the preferable upper limit is 2%.

P: 0.02 to 0.2%

P has the action of improving the roughness of the finished surface. P also has the action of remarkably improving convenience of the chip disposability since P facilitates propagation of cracks in the chip. In order to realize such effects, P should be included at least at a content of 0.02%. Excessive addition of P, however, results in the poor hot workability, and the content should be up to 0.2%. It is to be noted that the preferable lower limit of the P content is 0.05%, and the preferable upper limit is 0.15%.

S: 0.2 to 1%

S is an element which is useful in improving the machinability since it binds to Mn in the steel to form MnS which functions as a focus of the stress applied in the cutting process to facilitate separation of the chip. In order to realize such effects, S should be included at least at a content of 0.2%. An excessive addition of S at a content in excess of 1% may invite loss of hot workability. It is to be noted that the preferable lower limit of the S content is 0.3%, and the preferable upper limit is 0.8%.

Total Al: not More than 0.005% (More than 0%)

Al is an element which is useful for ensuring strength by solid solution strengthening, and also, in the deoxidation. Al functions as a strong deoxidating agent and forms an oxide ($Al_2O_3$) The thus formed $Al_2O_3$ contributes to the formation of the inclusion comprising a MnO—$Al_2O_3$—MnS system. When the content of Al is in excess of 0.005%, oxygen concentration in the MnS is no longer maintained due to the increased concentration of the $Al_2O_3$ in the inclusion, and this leads to unfavorable roughness of the finished surface. It is to be noted that the upper limit is preferably 0.003%, and more preferably 0.001%.

O: 0.008 to 0.03%

O binds to Mn and forms MnO, and since MnO contains a large amount of S, a MnO—MnS complex inclusion is formed. Since this MnO—MnS complex inclusion is not easily extended by the rolling, and retains its quasi-spherical shape, it functions as the site to which stress is focused in the cutting process. It is the reason why O is intentionally left. The effect, however, is insufficient when the content is less than 0.008% while a content in excess of 0.03% induces internal defects in the ingot due to the CO gas. Therefore, O should be controlled at a content in the range of 0.008 to 0.03%. It is to be noted that the preferable lower limit of the O content is 0.01%, and the preferable upper limit is 0.03%.

N: 0.002 to 0.03%

N is an element which has influence on the amount of built-up edge generated, and its content affects roughness of the finished surface. When the content of N is less than 0.002%, amount of the built-up edge formed will be excessive, and the finished surface will suffer from unfavorable roughness. N also tends to segregate along the dislocation in the matrix, and during the cutting, the N segregated along the dislocation embrittle the matrix and facilitates crack propagation to thereby facilitate chip breakage (i.e. chip disposability). However, when excessive N is present at content in excess of 0.03%, bubbles (blow holes) are likely to be generated in the process of the casting to result in internal and surface defects of the bloom, and the N content should be at most 0.03%. It is to be noted that the preferable lower limit of the N content is 0.005%, and the preferable upper limit is 0.025%.

In the low carbon resulfurized free-machining steel of the present invention, the part other than the components as described above (the residue) basically comprises iron. The steel, however, may contain other trace elements, and the steel containing such elements are also within the technical scope of the present invention. The low carbon resulfurized free-machining steel of the present invention also inevitably contain impurities (for example, Cu, Sn, and Ni), and such impurities are allowable as long as the merits of the present invention are not killed.

In the low carbon resulfurized free-machining steel of the present invention, optional control such as (1) content of the soluble N is in the range of 0.002 to 0.02%, and (2) inclusion of at least one element selected from the group consisting of Ti, Cr, Nb, V, Zr, and B at a total content of up to 0.02% (more than 0%) are useful for the reasons as described below.

Content of soluble N: 0.002 to 0.02%

As described above, the soluble N in the steel is involved in the generation of minute cracks, and adequate control of the content of the soluble N contributes to the realization of a free-machining steel having good machinability. In order to realize such effects, the soluble N is preferably present in the steel at a content of at least 0.002%, and the content in excess of 0.02% leads to an increased defects.

At Least One Element Selected from the Group Consisting of Ti, Cr, Nb, V, Zr, and B: up to 0.02% in Total (More than 0%)

These are elements which fix to N to form nitrides. When these elements are present at an excessive amount, content of the soluble N decreases to the level below the necessary amount. Accordingly, these components are preferably controlled to a total content of up to 0.02%.

In the low carbon resulfurized free-machining steel of the present invention, the machinability has been improved by controlling the average oxygen concentration of the MnS in the steel to the level of at least 0.4%. In order to satisfy such requirement, the steel composition may be controlled by limiting the soluble Si in the steel to the level of up to 35 ppm and the soluble Al to the level of up to 1 ppm to thereby control the average composition of the inclusions in the bloom standardized in terms of MnO—$SiO_2$—MnS ternary system (namely, by assuming the sum of MnO, $SiO_2$, and MnS to be 100%) such that MnS is up to 60%, $SiO_2$ is up to 4%, and MnO is at least 36%. It is to be noted that, the size of the non-metallic inclusions to be realized has been controlled to those "having an area of at least 25 $\mu m^2$" since the non-metallic inclusion smaller than such size is ineffective in improving the machinability by acting as the crack-generation site.

Next, the reason why the oxygen concentration in the MnS can be controlled to the level of at least 0.4% by controlling the composition of the inclusion as described above is described by using the FIG. 1. FIG. 1 is a phase diagram of an isothermal cross section of MnO—$SiO_2$—MnS ternary system at 1250° C. ("Iron and Steel (in Japanese)" Vol. 81 (1995) No. 12, P. 1109). In FIG. 1, "doubly satd." means that the two phases indicated are both saturated.

In the present invention, Al and Si having strong deoxidation ability are reduced to the minimum level, and the inclusion in the solidified bloom having the MnO—$SiO_2$—MnS system is realized as a result of such reduction. The bloom is retained at an elevated temperature of about 1250° C. before the blooming. At this stage, those having improved roughness and poor roughness of the finished surface were plotted in the phase diagram (FIG. 1), and it was then found that those having poor machinability have high $SiO_2$ concentration, and those having good machinability have low $SiO_2$ concentration (Nos. 1 to 15 in Tables 1 and 2, below).

Such result corresponds to the conditions shown in the phase diagram of this system as shown in FIG. 1 in which the MnS saturated zone projects out with increase in the $SiO_2$ content. This means that, when the $SiO_2$ content is high (when the $SiO_2$ content is 4% or higher), a large amount of pure MnS (that is, the MnS containing no oxygen) generates during the heating to 1250° C., and as a consequence, increase in the oxygen concentration in the MnS is prohibited.

On the other hand, it is estimated that, when the composition of the MnO—$SiO_2$—MnS inclusion is within the range of the inclusion composition as described above, the steel will be plotted in the liquid phase inclusion zone or MnO saturated zone of the phase diagram corresponding to the MnS having a high oxygen concentration (that is, a concentration of at least 0.4%). As a consequence, the oxygen concentration in the MnS increases during the heating before the blooming, and MnS becomes less susceptible to deformation in the following rolling conducted for producing a bloom, a bar, or a wire, and a product containing a large spherical MnS is thereby produced.

In the production of the low carbon resulfurized free-machining steel according to the present invention, the control of the soluble Si in the steel to the level of up to 35 ppm, and the soluble Al to the level of up to 1 ppm may be accomplished basically by continuous casting. Productivity is improved when the production is accomplished by the continuous casting. However, the production is riot limited to such method, and ingot making may be used instead of the continuous casting.

The production by continuous casting can be accomplished, for example, as described below. First, in the converter, C is reduced by blowing to realize the C concentration of 0.04% or lower to thereby realize the situation with high free oxygen (dissolved oxygen) concentration in the molten steel. The free oxygen concentration at this stage is preferably 500 ppm or higher. Next, alloys such as Fe—Mn alloy and Fe—S alloy are added when the molten steel is taken out of the converter. These alloys contain Si and Al as impurities, and when such alloys are added to the oxygen-rich molten steel taken out of the converter, Si and Al are converted to $SiO_2$ and $Al_2O_3$ by oxidation. In the following processing of the molten steel, these $SiO_2$ and $Al_2O_3$ will float in the slag which is to be separated. As a consequence, Si and Al remaining in the steel is reduced to the level of the intended concentration. In this process, it is important that 70% or more of the Fe—Mn alloy and Fe—S alloy which are added for the control of the composition is added when the molten steel is taken out of the converter to reduce the Al and the Si, and the remaining 30% or less is added during the processing of the molten steel. The procedure as described above promotes exclusion of the impurities such as Al and Si, and the intended levels of the soluble Si and the soluble Al are thereby realized.

Next, the present invention is described in detail by referring to Examples which by no means limit the scope of the present invention. It is to be understood that the present invention may be modified in various ways without departing from the scope of the invention as described above, and as will be described below, and such modifications are also within the scope of the present invention.

EXAMPLES

Various types of molten steels containing Si, Mn, S, and N at various contents were prepared by using a molten steel processing facility including a 3 ton induction furnace, a 100 ton converter, and a ladle. Of such components, content of Si and Al were adjusted by changing concentration of Si and Al in the Fe—Mn alloy and the Fe—S alloy added. The thus obtained molten steel was measured just before the casting in a predetermined mold for the oxygen concentration using a free oxygen probe (product name "HYOP10A-C150" manufactured by Heraeus Electro-Nite Co., Ltd.), and this oxygen concentration was regarded to be the concentration of the free oxygen.

The molten steel was cast by bloom continuous casting to a cross section of 300 mm×430 mm, or in the case of 3 ton induction furnace, by using a cast iron mold with a cross section of 300 mm×430 mm which had been designed to realize a cooling speed equivalent to that of the bloom casting.

A sample was collected from the region near the surface of the resulting cast block (or ingot) where the steel had been cooled at a high speed, and the sample was chemically analyzed to determine the composition. The results are shown in Table 1, below.

TABLE 1

| Test | Chemical composition (% by mass) | | | | | | | | | | |
|---|---|---|---|---|---|---|---|---|---|---|---|
| No. | C | Si | Mn | P | S | Al | Pb | Total O | Free O | N | Others |
| 1 | 0.08 | 0.002 | 1.10 | 0.080 | 0.33 | 0.001 | — | 0.0214 | 0.0055 | 0.0124 | Ti: 0.003, Cr: 0.004 |
| 2 | 0.07 | 0.003 | 1.10 | 0.079 | 0.31 | 0.001 | — | 0.0314 | 0.0055 | 0.0134 | Ti: 0.001, Cr: 0.004 |
| 3 | 0.08 | 0.002 | 1.20 | 0.083 | 0.45 | 0.001 | — | 0.0206 | 0.0050 | 0.0135 | Ti: 0.001, Cr: 0.005 |
| 4 | 0.07 | 0.002 | 1.22 | 0.087 | 0.34 | 0.001 | — | 0.0193 | 0.0050 | 0.0068 | Ti: 0.003, Cr: 0.010 |

TABLE 1-continued

| Test | Chemical composition (% by mass) | | | | | | | | | | |
|---|---|---|---|---|---|---|---|---|---|---|---|
| No. | C | Si | Mn | P | S | Al | Pb | Total O | Free O | N | Others |
| 5 | 0.08 | 0.002 | 1.40 | 0.076 | 0.40 | 0.001 | — | 0.0168 | 0.0043 | 0.0130 | Ti: 0.001, Cr: 0.007 |
| 6 | 0.07 | 0.003 | 1.41 | 0.082 | 0.40 | 0.001 | — | 0.0182 | 0.0043 | 0.0075 | Ti: 0.003, Cr: 0.005, Zr: 0.008 |
| 7 | 0.07 | 0.001 | 1.50 | 0.081 | 0.42 | 0.002 | — | 0.0221 | 0.0040 | 0.0135 | Ti: 0.001, Cr: 0.0004 |
| 8 | 0.07 | 0.002 | 1.51 | 0.083 | 0.43 | 0.001 | — | 0.0221 | 0.0040 | 0.0065 | Ti: 0.002, Cr: 0.008, V: 0.009 |
| 9 | 0.07 | 0.003 | 1.60 | 0.079 | 0.45 | 0.001 | — | 0.0167 | 0.0038 | 0.0150 | Ti: 0.003, Cr: 0.005 |
| 10 | 0.08 | 0.003 | 1.62 | 0.086 | 0.46 | 0.002 | — | 0.0158 | 0.0037 | 0.0053 | Ti: 0.003, Cr: 0.008, V: 0.008 |
| 11 | 0.08 | 0.003 | 1.70 | 0.077 | 0.48 | 0.001 | — | 0.0139 | 0.0036 | 0.0145 | Ti: 0.003, Cr: 0.0005 |
| 12 | 0.08 | 0.003 | 1.72 | 0.081 | 0.49 | 0.002 | — | 0.0137 | 0.0035 | 0.0101 | Ti: 0.003, Cr: 0.005 |
| 13 | 0.07 | 0.003 | 1.85 | 0.080 | 0.52 | 0.001 | — | 0.0127 | 0.0033 | 0.0186 | Ti: 0.005, Cr: 0.010, Nb: 0.005 |
| 14 | 0.08 | 0.003 | 1.88 | 0.083 | 0.53 | 0.004 | — | 0.0125 | 0.0032 | 0.0179 | Ti: 0.003, Cr: 0.005, B: 0.002 |
| 15 | 0.07 | 0.004 | 2.00 | 0.084 | 0.56 | 0.004 | — | 0.0118 | 0.0030 | 0.0180 | Ti: 0.005, Cr: 0.003, Nb: 0.005 |
| 16 | 0.07 | 0.007 | 1.40 | 0.079 | 0.40 | 0.003 | — | 0.0168 | 0.0043 | 0.0057 | Ti: 0.002, Cr: 0.013 |
| 17 | 0.07 | 0.005 | 1.10 | 0.077 | 0.31 | 0.002 | — | 0.0214 | 0.0055 | 0.0040 | Ti: 0.003, Cr: 0.012 |
| 18 | 0.07 | 0.007 | 1.40 | 0.079 | 0.40 | 0.003 | — | 0.0168 | 0.0043 | 0.0054 | Ti: 0.004, Cr: 0.011 |
| 19 | 0.07 | 0.004 | 1.21 | 0.078 | 0.34 | 0.006 | — | 0.0195 | 0.0050 | 0.0050 | Ti: 0.003, Cr: 0.010 |
| 20 | 0.08 | 0.009 | 1.70 | 0.079 | 0.48 | 0.005 | — | 0.0139 | 0.0036 | 0.0055 | Ti: 0.003, Cr: 0.010 |
| 21 | 0.07 | 0.007 | 1.21 | 0.082 | 0.34 | 0.009 | — | 0.0195 | 0.0050 | 0.0080 | Ti: 0.008, Cr: 0.008, Zr: 0.007 |
| 22 | 0.08 | 0.003 | 1.70 | 0.077 | 0.48 | 0.001 | — | 0.0139 | 0.0036 | 0.0230 | Ti: 0.003, Cr: 0.005 |
| 23 | 0.07 | 0.004 | 1.50 | 0.075 | 0.42 | 0.003 | — | 0.0157 | 0.0040 | 0.0110 | Ti: 0.001, Cr: 0.010, Zr: 0.010, V: 0.005 |

The resulting ingot was heated at 1270° C. for 1 hour, and the ingot was bloomed after the heating to a cross section of 155 mm×155 mm. After further rolling to a diameter of 25 mm and pickling, a bar of having a diameter of 22 mm was produced by drawing for use in a cutting test. The rolling was conducted at 1000° C., and forced cooling from 800° C. to 500° C. was conducted at an average cooling speed of about 1.5° C./sec. The temperature of the steel material was measured by a radiation thermometer.

Each steel material was evaluated for their composition of the inclusions (composition of the oxides), average oxygen concentration in the MnS, and contents of soluble Al, soluble Si, and soluble N, and the steel material was also evaluated by a cutting test.

[Measurement of the Inclusion Composition]

Number of oxides and sulfides having an area of 25 $\mu m^2$ or more in a region of 100 $mm^2$ (10 mm×10 mm) was counted by compositional analysis using EPMA after polishing a D/4 region (the part corresponding to 108 mm from the surface along the center line of the width of 300 mm) in the cross section of the solidified bloom (430 mm×300 mm). 200 to 300 sulfides were detected per 1 field (100 $mm^2$). The results were calculated in terms of oxides and sulfides. The main components detected were MnS, MnO, $SiO_2$, and FeO. Since the FeO that had been detected may correspond to steel matrix, the average composition was determined by standardizing the results in terms of a ternary MnO—$SiO_2$—MnS system (standardized so that these 3 components constitutes 100%).

[Average Oxygen Concentration in MnS]

Using an image analyzer, MnS having an area or not less than 25 $\mu m^2$ was selected, and average oxygen concentration was determined for the selected MnS using an SEM-EDX.

[Measurement of Soluble Si and Al]

The analysis was conducted using ims5f secondary ion mass spectrometer (manufactured by CAMECA) by the following procedure. For each specimen (test sample), secondary ion images of Al and Si were observed in an area of 500×500 (μm), and 3 locations without Al and Si enrichment were selected for each region to conduct analysis in the depth direction. In this detection, negative ions were detected by irradiating $Cs^+$ ion since the Si to be detected is an electrically negative element. First, secondary ion image of $Si^-$ in the specimen surface was observed, and analysis in the depth direction was conducted in the area which had been selected for the absence of the Si enrichment. The secondary ion strength measured was converted to the concentration by using sensitivity index calculated from the pure iron having $^{28}Si$ ion incorporated by ion implantation. The actual conditions of the measurement were as described below.

Conditions for the primary ion:

Analysis of Al: $O^{2+}$, 8 eV, 100 nA

Analysis of Si: $Cs^+$, 14.5 eV, 25 nA

Irradiation area: 80×80 (μm)

Analysis area: area with a diameter of 8 μm

Polarity of the secondary ion:

Analysis of Al: positive

Analysis of Si: negative

Degree of vacuum of the test chamber: $1.2\times10^{-7}$ Pa

Sputtering speed:

Analysis of Al: about 32.0 angstrom/sec in terms of pure iron

Analysis of Si: about 36.6 angstrom/sec in terms of pure iron

Electron irradiation: None

[Measurement of Soluble N]

Content of soluble N was determined from the difference between the total content of N (determined by inert gas fusion thermal conductivity method) and content of the compound N (extraction by dissolution using a solution of 10% acetylacetone+1% tetramethylammonia chloride+methanol, collecting by filtration using a 1 μm filter, and measurement with indophenol absorptiometer).

The conditions used in the cutting test were as described below. The finished surface after the cutting test and the surface defects of the steel piece were evaluated by the criteria as described below.

[Conditions of Cutting Test]

Tool: high speed tool steel SKH4A

Cutting speed: 100 m/min.

Feed: 0.01 nun/rev.

Depth of cut: 0.5 mm

Cutting oil: water-insoluble chlorine-based cutting oil

Cutting length: 500 m

[Evaluation Criteria]

Evaluation of the finished surface: surface roughness was evaluated by maximum height Rz according to JIS B 0601 (2001).

Evaluation of surface defects: Bloomed and rolled steel piece (with the cross section size of 155 mm×155 mm) was visually inspected for surface defects, and the piece was evaluated "no defects" when no further finishing with a grinder was required.

The results of the cutting test are shown in Table 2, below together with the composition of the inclusion (composition of the oxides), the average oxygen concentration in MnS, and the contents of the soluble Al, soluble Si, and soluble N.

TABLE 2

| Test No. | Composition of inclusion (% by mass) MnO | $SiO_2$ | MnS | Average O concentration in MnS (% by mass) | Soluble Al (ppm) | Soluble Si (ppm) | Soluble N (% by mass) | Roughness of the finished cut surface Rz (μm) | Surface defects |
|---|---|---|---|---|---|---|---|---|---|
| 1 | 51.1 | 0.8 | 48.1 | 0.73 | 0.048 | 11 | 0.0103 | 13 | No |
| 2 | 37.0 | 3.5 | 59.5 | 0.43 | 0.134 | 29 | 0.0124 | 14 | No |
| 3 | 55.5 | 0.9 | 43.6 | 0.79 | 0.087 | 14 | 0.0123 | 11 | No |
| 4 | 57.1 | 1.1 | 41.8 | 0.80 | 0.043 | 17 | 0.0033 | 13 | No |
| 5 | 52.1 | 1.2 | 46.7 | 0.72 | 0.065 | 19 | 0.0108 | 9 | No |
| 6 | 54.3 | 1.3 | 44.4 | 0.75 | 0.073 | 18 | 0.0038 | 11 | No |
| 7 | 55.4 | 1.3 | 43.3 | 0.88 | 0.105 | 9 | 0.0120 | 8 | No |
| 8 | 54.0 | 1.1 | 44.9 | 0.75 | 0.067 | 12 | 0.0021 | 10 | No |
| 9 | 49.1 | 1.5 | 49.4 | 0.66 | 0.075 | 21 | 0.0125 | 9 | No |
| 10 | 48.0 | 2.0 | 50.0 | 0.62 | 0.108 | 25 | 0.0033 | 12 | No |
| 11 | 46.0 | 2.4 | 51.6 | 0.57 | 0.059 | 27 | 0.0120 | 12 | No |
| 12 | 45.2 | 2.7 | 52.1 | 0.54 | 0.098 | 26 | 0.0041 | 14 | No |
| 13 | 43.5 | 3.0 | 53.5 | 0.50 | 0.064 | 30 | 0.0155 | 13 | No |
| 14 | 41.0 | 3.2 | 55.8 | 0.45 | 0.174 | 30 | 0.0143 | 19 | No |
| 15 | 38.5 | 3.5 | 58.0 | 0.41 | 0.235 | 34 | 0.0141 | 17 | No |
| 16 | 32.0 | 6.0 | 62.0 | 0.17 | 0.121 | 60 | 0.0021 | 38 | No |
| 17 | 35.0 | 4.4 | 60.6 | 0.30 | 0.123 | 43 | 0.0003 | 26 | No |
| 18 | 32.0 | 6.0 | 62.0 | 0.17 | 0.121 | 61 | 0.0002 | 28 | No |
| 19 | 36.0 | 4.2 | 59.8 | 0.33 | 0.327 | 32 | 0.0013 | 26 | No |
| 20 | 39.0 | 7.0 | 54.0 | 0.28 | 0.293 | 71 | 0.0030 | 40 | No |
| 21 | 32.0 | 5.0 | 63.0 | 0.23 | 1.030 | 61 | 0.0025 | 36 | No |
| 22 | 46.0 | 2.4 | 51.6 | 0.57 | 0.059 | 27 | 0.0210 | 12 | Yes |
| 23 | 36.0 | 4.0 | 60.0 | 0.40 | 0.099 | 35 | 0.0015 | 22 | No |

As demonstrated in the results, the test samples fulfilling the requirements of the present invention (Test Nos. 1 to 15) exhibited fine surface roughness (maximum height Rz) after the cutting, demonstrating the improved machinability.

In contrast, the test samples not fulfilling all of the requirements of the present invention (Test Nos. 16 to 23) were inferior in some of the properties.

Figure 2:
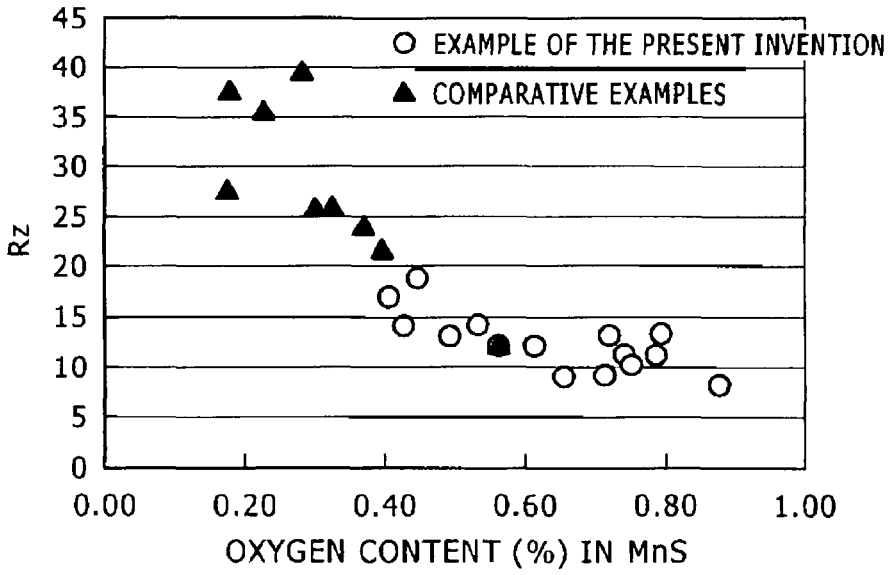
FIG. 2 is a graph showing the roughness (maximum height Rz) of the finished surface after the cutting in relation to the oxygen content in the MnS.
Figure 3:
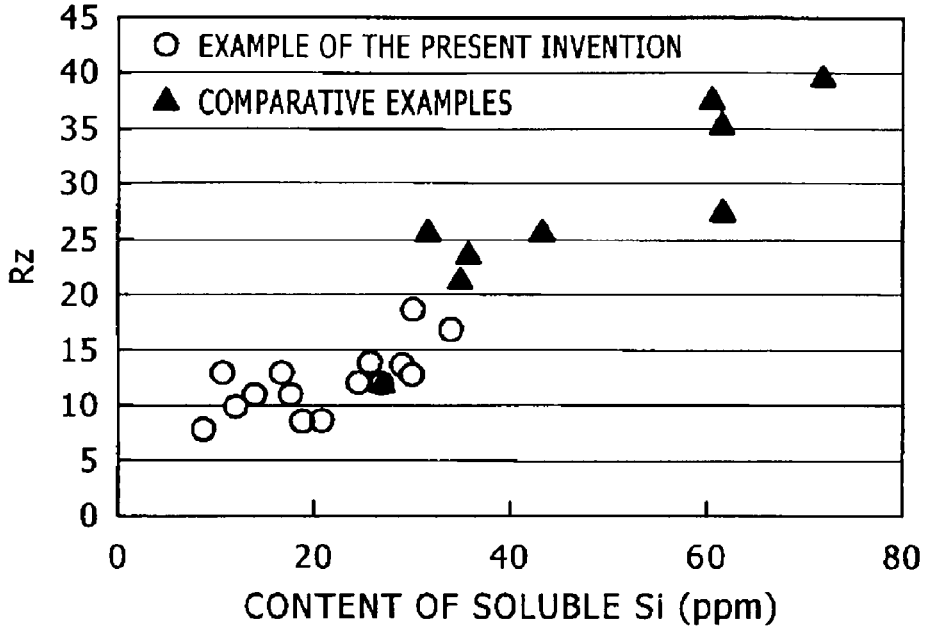
FIG. 3 is a graph showing the roughness (maximum height Rz) of the finished surface after the cutting in relation to the content of soluble Si.
Figure 4:
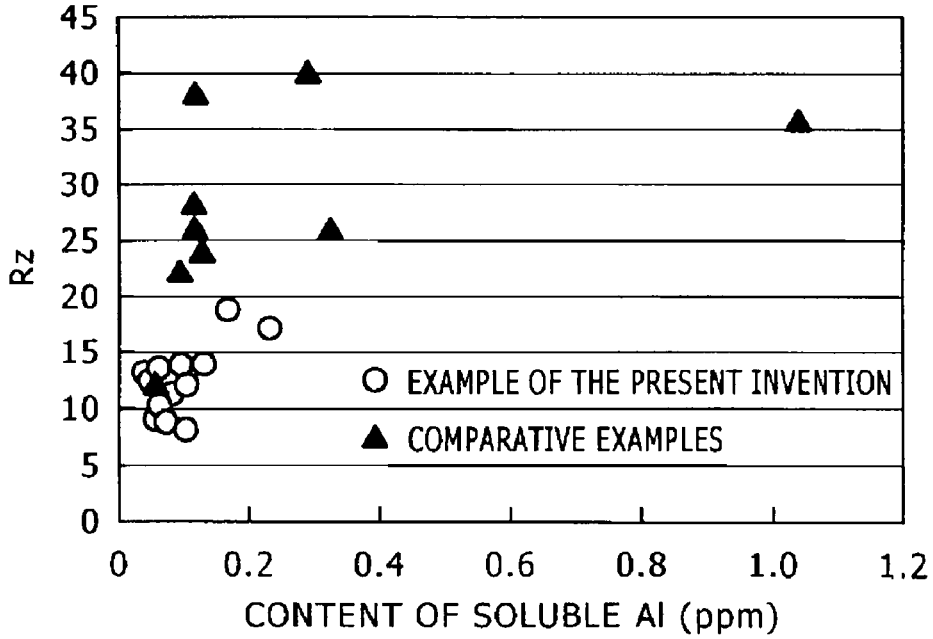
FIG. 4 is a graph showing the roughness (maximum height Rz) of the finished surface after the cutting in relation to the content of soluble Al.
Figure 5:
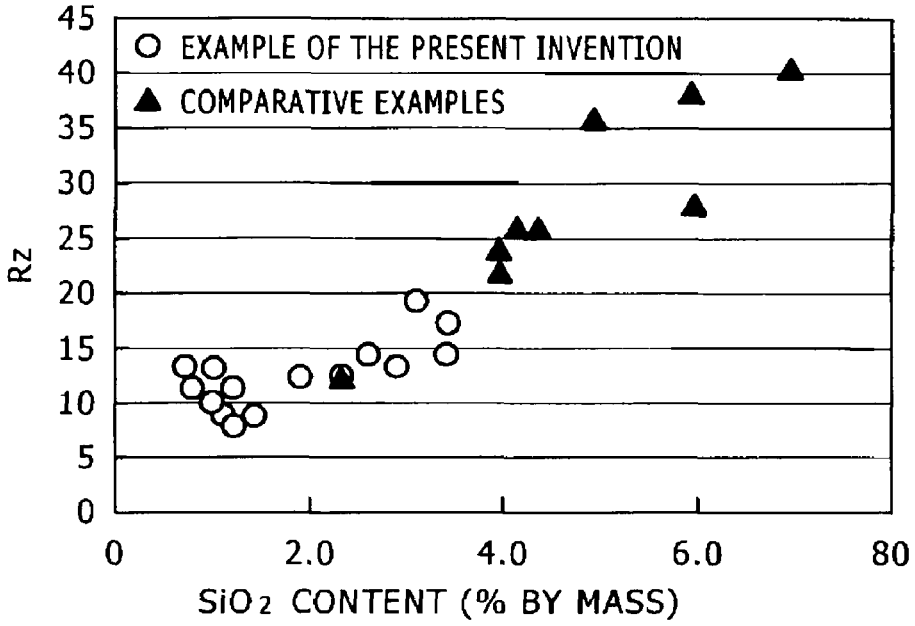
FIG. 5 is a graph showing the roughness (maximum height Rz) of the finished surface after the cutting in relation to the content of $SiO_2$ in the inclusion.
Figure 6:
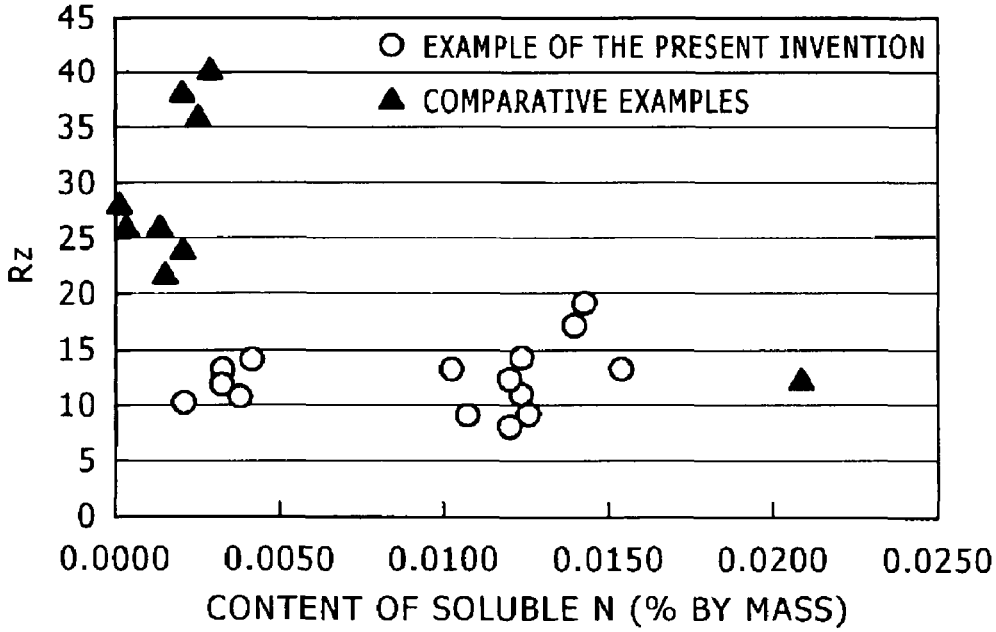
FIG. 6 is a graph showing the roughness (maximum height Rz) of the finished surface after the cutting in relation to the content of soluble N.

Based on the results as shown above, the relation of the roughness (maximum height Rz) of the finished surface after the cutting to the oxygen concentration in the MnS was plotted in FIG. 2; the relation of the roughness (maximum height Rz) of the finished surface after the cutting to the concentration of the soluble Si was plotted in FIG. 3; the relation of the roughness (maximum height Rz) of the finished surface after the cutting to the concentration of the soluble Al was plotted in FIG. 4; the relation of the roughness (maximum height Rz) of the finished surface after the cutting to the $SiO_2$ concentration in the inclusion was plotted in FIG. 5; and the relation of the roughness (maximum height Rz) of the finished surface after the cutting to the concentration of soluble N was plotted in FIG. 6.

The invention claimed is:

1. A low carbon resulfurized free-machining steel having a high machinability, consisting of:

C: 0.02 to 0.15% by mass;

Si: more than 0% by mass up to 0.004% by mass;

Mn: 1.20 to 1.70% by mass;

P: 0.02 to 0.2% by mass;

S: 0.40 to 0.48% by mass;

Al: more than 0% by mass up to 0.005% by mass;

0: 0.008 to 0.04% by mass;

N: 0.005 to 0.025% by mass, wherein the total of at least one element selected from the group consisting of Ti, Cr, Nb, V, Zr, and B is suppressed to the level of up to 0.02% by mass; and a balance of iron and inevitable impurities, wherein the average oxygen concentration in MnS in the steel is at least 0.4% by mass, wherein the content of soluble N is 0.002 to 0.02% by mass, wherein the soluble Si in the steel is up to 35 ppm, and the soluble Al is up to 1 ppm, wherein the average composition of non-metallic inclusions having an area of at least 25 $\mu m^2$ in the solidified bloom standardized by a MnO—$SiO_2$—MnS ternary system includes up to 60% by mass of MnS, up to 4% by mass of $SiO_2$, and at least 36% by mass of MnO.

2. The low carbon resulfurized free-machining steel of claim 1, wherein the average oxygen content in MnS in the steel is at least 0.6%.

3. The low carbon resulfurized free-machining steel of claim 1, wherein the average oxygen content in MnS in the steel is at least 0.8%.

4. The low carbon resulfurized free-machining steel of claim 1, consisting of 0.05 to 0.12% by mass of C.

5. The low carbon resulfurized free-machining steel of claim 1, consisting of more than 0% by mass up to 0.003% by mass of Si.

6. The low carbon resulfurized free-machining steel of claim 1, consisting of 0.05 to 0.15% by mass of P.

7. The low carbon resulfurized free-machining steel of claim 1, consisting of more than 0% by mass up to 0.003% by mass of Al.

8. The low carbon resulfurized free-machining steel of claim 1, consisting of more than 0% by mass up to 0.001% by mass of Al.

9. The low carbon resulfurized free-machining steel of claim 1, consisting of 0.01 to 0.03% by mass of O.

* * * * *